US012467705B2

(12) United States Patent
Mock

(10) Patent No.: US 12,467,705 B2
(45) Date of Patent: Nov. 11, 2025

(54) AMBIDEXTROUS BOLT CATCH SYSTEM

(71) Applicant: Jarret Christian Mock, Fort Myers, FL (US)

(72) Inventor: Jarret Christian Mock, Fort Myers, FL (US)

( * ) Notice: Subject to any disclaimer, the term of this patent is extended or adjusted under 35 U.S.C. 154(b) by 0 days.

(21) Appl. No.: 18/628,778

(22) Filed: Apr. 7, 2024

(65) Prior Publication Data

US 2025/0314443 A1 Oct. 9, 2025

(51) Int. Cl.
*F41A 17/36* (2006.01)
*F41A 35/06* (2006.01)

(52) U.S. Cl.
CPC ..... *F41A 17/36* (2013.01); *F41A 35/06* (2013.01)

(58) Field of Classification Search
CPC ..... F41A 17/34; F41A 17/36; F41A 17/40; F41A 17/42; F41A 3/68; F41A 35/06
See application file for complete search history.

(56) References Cited

U.S. PATENT DOCUMENTS 2,389,631 A * 11/1945 Moore ..... F41A 3/32 89/142
5,608,981 A * 3/1997 Canaday ..... F41A 15/16 42/25
9,091,499 B2 * 7/2015 Overstreet ..... F41A 9/70
9,291,412 B1 3/2016 Montes
9,651,328 B1 5/2017 Oglesby
11,512,920 B1 11/2022 Oglesby
11,536,531 B1 12/2022 Geissele et al.
2011/0247482 A1 * 10/2011 Overstreet ..... F41A 17/36 89/138
2011/0247483 A1 * 10/2011 Overstreet ..... F41A 9/70 89/138
2013/0014416 A1 * 1/2013 Sisgold ..... F41A 9/66 42/17
2014/0060310 A1 * 3/2014 Overstreet ..... F41A 17/36 89/138
2017/0160026 A1 * 6/2017 Walther ..... F41A 35/06
2021/0270551 A1 9/2021 Underwood et al.
2022/0196361 A1 * 6/2022 Nedev ..... F41A 3/66
2022/0341691 A1 * 10/2022 Wingrove ..... F41A 17/36

FOREIGN PATENT DOCUMENTS

EP 4194796 A1 * 6/2023 ..... F41A 17/36
WO WO-2017096371 A1 * 6/2017 ..... F41A 17/36
WO WO-2021061926 A1 * 4/2021 ..... F41A 9/65

OTHER PUBLICATIONS

Robinson Armament Co., XCR-L Lower Receiver Parts, Feb. 8, 2024 or earlier, https://robinsonarmament.com/xcr-l-lower-receiver-parts/.

* cited by examiner

*Primary Examiner* — Jonathan C Weber
(74) *Attorney, Agent, or Firm* — George F. Wallace

(57) ABSTRACT

An ambidextrous bolt catch system for a firearm receiver includes a neck having upper, middle, and lower portions; a bolt catch at the upper portion; and an ambidextrous actuator at the lower portion having a spring retention structure. The middle portion extends along a plane perpendicular to a vector extending from the rear to the front of the receiver, and includes a first terminal point towards one side of the receiver, the upper portion extends along the plane and includes a second terminal point towards the side and further than the first terminal point, and the lower portion extends along the plane and includes a third terminal point towards the side and beyond the first terminal point.

16 Claims, 3 Drawing Sheets

AMBIDEXTROUS BOLT CATCH SYSTEM

BACKGROUND OF THE INVENTION

A bolt catch is a component of a firearm that can lock a bolt carrier in place manually or automatically. Additionally, from such a locked state, a bolt catch can be placed in an unlocked stated to allow a locked bolt carrier to move freely.

Ambidextrous bolt catches render use thereof more convenient for left- and right-handed users.

SUMMARY OF THE INVENTION

It is an object of the present invention to provide an ambidextrous bolt catch system.

It is another object of the present invention to provide an ambidextrous bolt catch system that provides utility.

The present invention provides an ambidextrous bolt catch system configured for use in a firearm receiver.

In an exemplary embodiment of the present invention, an ambidextrous bolt catch system can be configured for use in a firearm receiver having rearward and forward ends and right and left sides.

In an exemplary aspect, such a system can include a neck having upper, middle, and lower portions, a bolt catch at the upper portion, and an ambidextrous actuator at the lower portion, with the actuator having a spring retention structure.

In additional exemplary aspects relative to a vector extending from the rearward end to the forward end; the middle portion can extend along a plane perpendicular to the vector, and can include a first furthest most terminal point towards one of the right and left sides, the upper portion can extend along the plane and can include a second furthest most terminal point towards the one of the right and left sides and beyond the first furthest most terminal point, and the lower portion can extend along the plane and can include a third furthest most terminal point towards the one of the first and left sides and beyond the first furthest most terminal point.

In a further exemplary aspect, an actuator can be integral with the lower portion or a separate component attached thereto.

In another exemplary aspect, at least two of the upper, middle, and lower portions can be integral.

In still another exemplary aspect, a neck can be provided with a uniform or non-uniform thickness.

In yet another exemplary aspect, a bolt catch can be configured to attach to the upper portion.

In still a further exemplary aspect, a spring retention structure can include an abutment surface.

In an additional exemplary aspect, a spring retention structure can include a protrusion.

These and other exemplary embodiments and aspects of the present invention are further described herein.

DETAILED DESCRIPTION OF THE INVENTION

It should be noted that this disclosure includes a plurality of embodiments, with a plurality of elements and aspects, and such elements and aspects need not necessarily be interpreted as being conjunctively required by one or more embodiments of the present invention. Rather, all combinations of the one or more elements and/or aspects can enable a separate embodiment of the present invention, which may be claimed with particularity in this or any one or more future filed Non-Provisional patent applications. Moreover, any particular materials, structures, and/or sizes disclosed herein, whether expressly or implicitly, are to be construed strictly as illustrative and enabling, and not necessarily limiting. Therefore, it is expressly set forth that such materials, structures, and/or sizes independently or in any combination thereof, are merely illustratively representative of one or more embodiments of the present invention and are not to be construed as necessary in a strict sense.

Further, to the extent the same element or aspect is defined differently within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are intended as exclusive. Therefore, any explicit, implicit, or apparent benefit from the disclosure herein is expressly deemed as applicable to the present invention.

According to the present invention, an ambidextrous bolt catch system can be formed of any one or more desired material, including but not limited to, plastic, rubber, metal, a crystalline material, or any other naturally-occurring or man-made material, insofar as functionally compatible with the present invention. In an exemplary embodiment, the present invention can be formed of aluminum, which optionally can be anodized.

Figure 1:
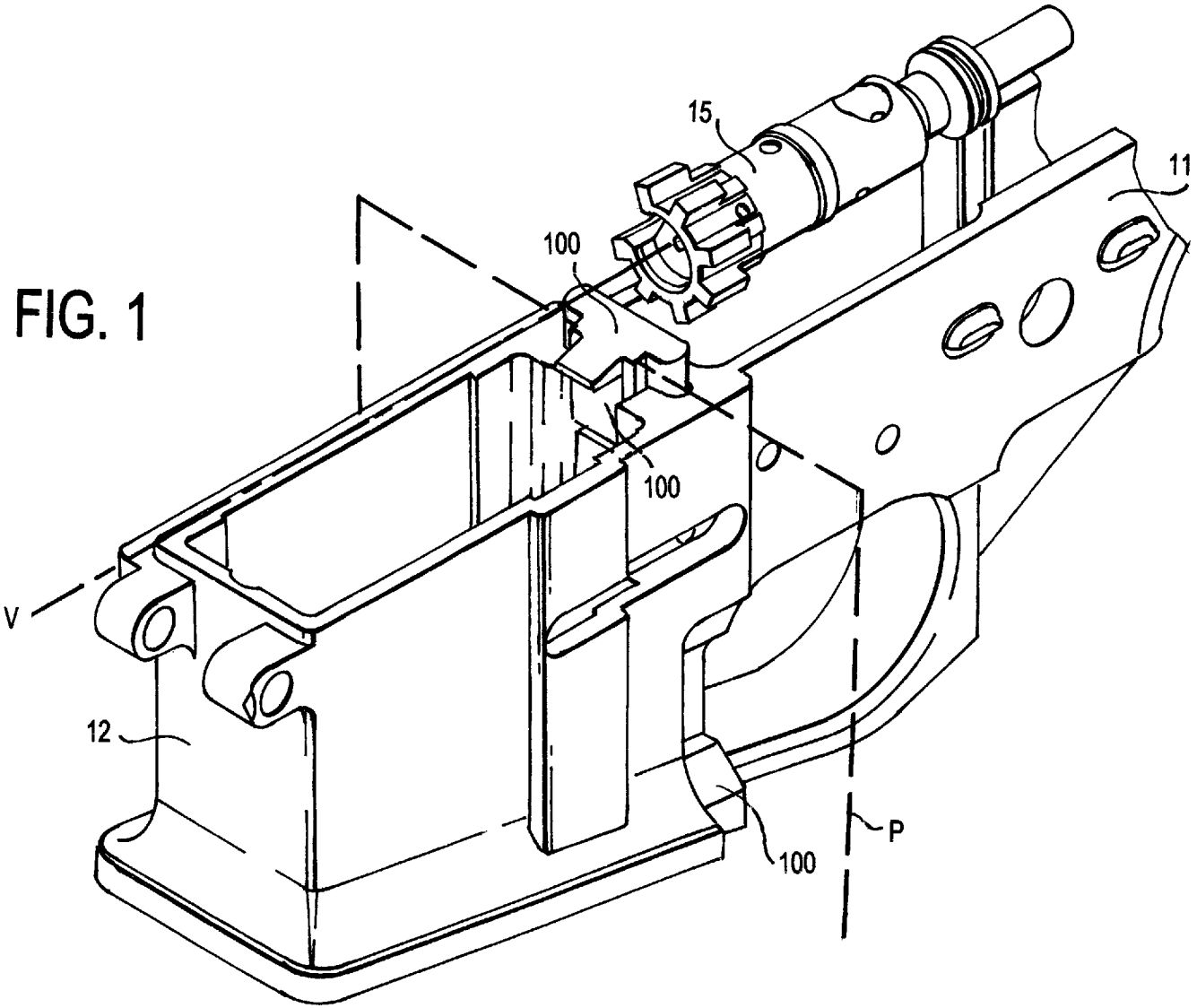
FIG. 1 illustrates an exemplary firearm receiver incorporating an exemplary bolt catch system of the present invention.

As illustratively shown in FIG. 1, an exemplary environment of the present invention includes a firearm receiver 1 having a rearward end 11, a forward end 12, a right side 13, a left side 14, and a bolt carrier 15. As illustratively shown, firearm receiver 1 can be a lower receiver based on the AR-15 platform; however, the present invention is not limited thereto, and can be applied to any functionally compatible receiver having a bolt carrier, including proprietary firearms.

For descriptive purposes herein, additionally illustrated are a vector V that can extend from rearward end 11 to forward end 12, and plane P that can extend perpendicular to the vector.

Figure 2B:
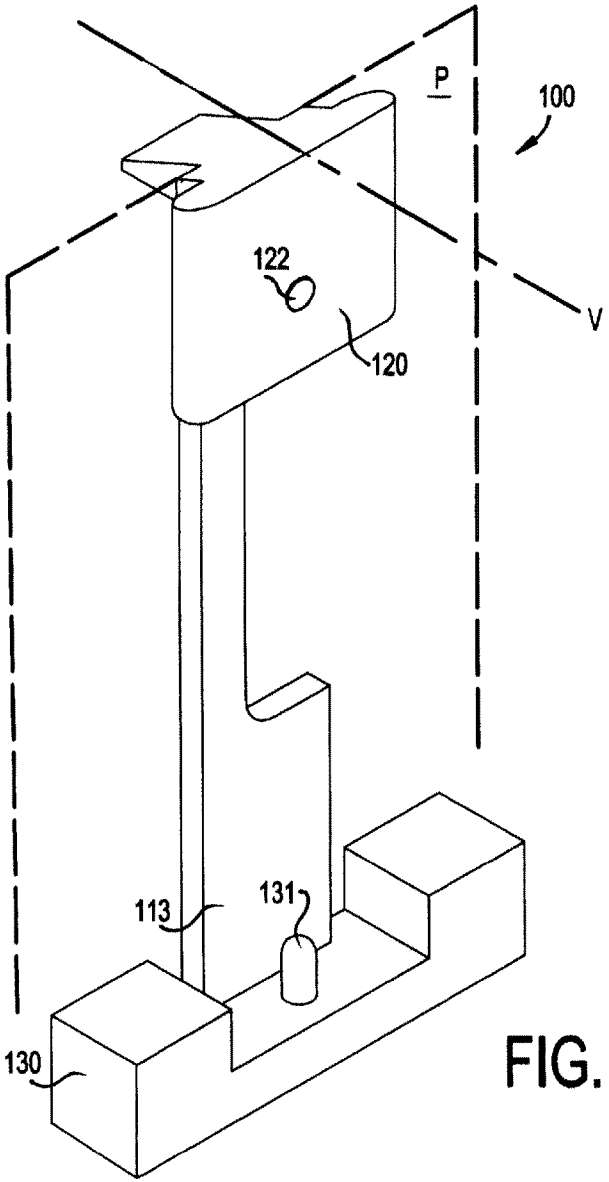
FIG. 2B illustrates an exemplary bolt catch system having an ambidextrous actuator, a neck, and a bolt catch.
Figure 2A:
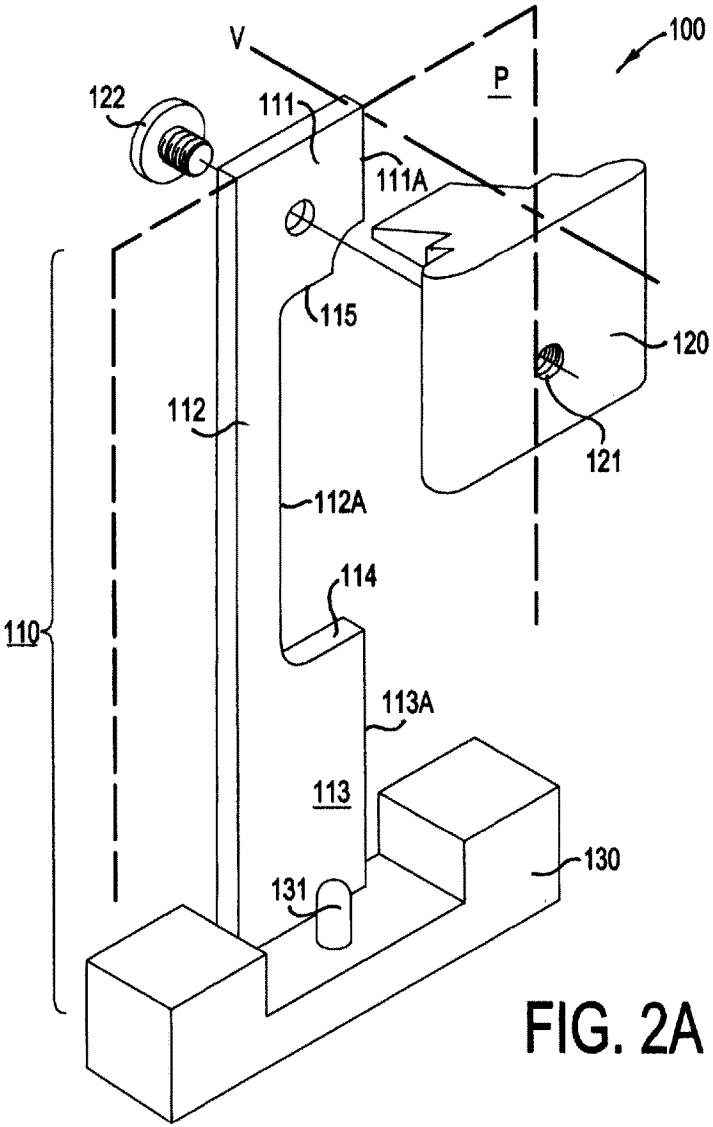
FIG. 2A illustrates an exemplary bolt catch system having an attachable bolt catch in an exploded perspective.

FIGS. 2A and 2B illustrate an exemplary embodiment of the present invention, in which FIG. 2A illustrates an exploded view of an exemplary ambidextrous bolt catch system 100, whilst FIG. 2B illustrates the exemplary system in a completed state.

As illustratively shown, an exemplary embodiment of an ambidextrous bolt catch system can include a neck 110 having an upper portion 111, a middle portion 112, and a lower portion 113; a bolt catch 120 positioned at the upper portion; and an ambidextrous actuator 130 positioned at the lower portion and having a spring retention structure 131, which can be provided as a protrusion. Notably, retention structure 131 can alternatively be provided as a retention channel, or any other functionally compatible structure to the extent desired.

In an exemplary aspect of the present invention, system 100 can be provided as a unitary piece of construction, or as two or more components fixed or attached together. As illustratively shown in FIG. 2A, bolt catch 120 can be provided as a separate component attached to upper portion 111, which can be effectuated with a threaded aperture 121 and a bolt 122, for example and not in limitation. Alternative or additional attachment structures, such as a clamp, adhesive, lock washer, weld, etc. can be utilized insofar as desired and functionally compatible with the present invention.

In a further exemplary aspect, as illustratively shown in FIGS. 1, 2A, and 2B, ambidextrous actuator 130 can be provided with a sufficient width that facilitates physical user manipulation from either side of firearm receiver 10.

In another exemplary aspect, neck 110 can be provided with any functionally compatible shape that can allow upward and downward movement within firearm receiver 10. In a further exemplary aspect, neck 110 can include one or more abutment structures that can abuttingly define maximum upward and/or downward positions of bolt catch system 100 by abutting a respective portion of firearm receiver 10. For example and not in limitation, neck 110 can be provided with a lower ledge 114, which can define a maximum upward position of system 100 and an upper ledge 115, which can define a maximum lower position of the system. Notably however, as can be a design choice, bolt catch system 100 can be particularly sized to allow actuator 130 to function as an abutment structure that can define the maximum upward position of the system 100.

In another exemplary aspect, with bolt catch system 100 engaged with receiver 10, upper, middle, and lower portions 111, 112, 113 can extend along plane P, as illustratively shown in FIGS. 2A and 2B.

In still another exemplary aspect, middle portion 112 can include a first furthest most terminal point 112*a* towards right side 13; upper portion 111 can include a second furthest most terminal point 111*a* towards the right side and beyond the first terminal point; and lower portion 113 can include a third furthest most terminal point 113*a*. Accordingly, second and third terminal points 111*a*, 113*a* can extend further to the right than first terminal point 112A. It should be noted that the present invention contemplates neck 110 can be mirrored along a vertical axis, in which case first, second, and third most terminal points 111*a*, 112*a*, and 113*a* can be towards left side 14 (instead of right side 13).

In an exemplary aspect, neck 110 can be provided with a uniform thickness or with a variable thickness.

Figure 3A:
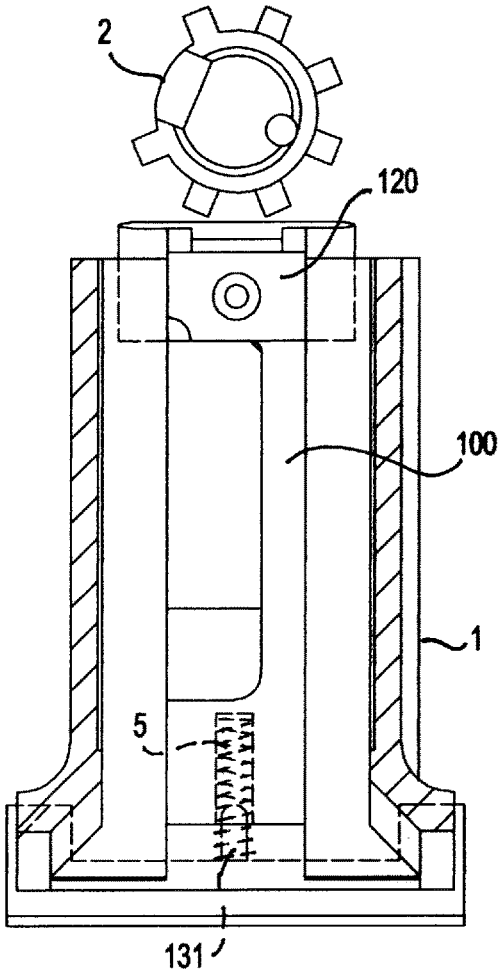
FIG. 3A illustrates an exemplary bolt catch system in a lower position.
Figure 3B:
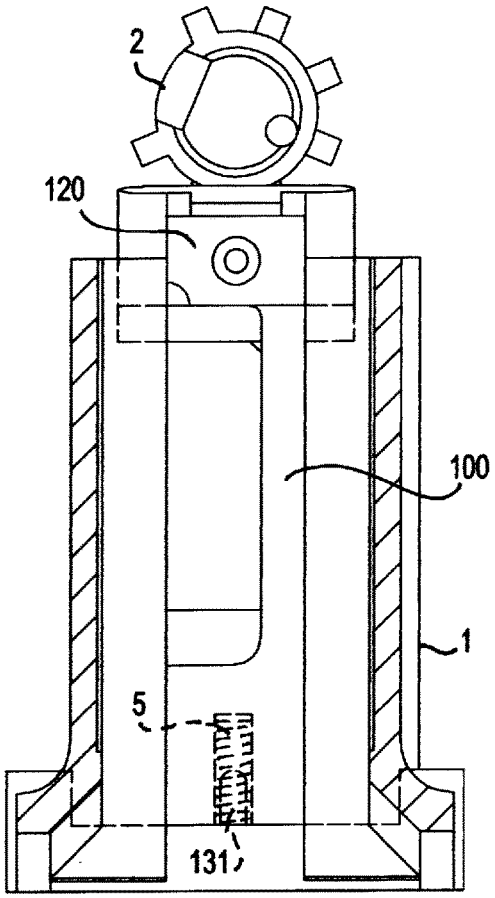
FIG. 3B illustrates an exemplary bolt catch system in an upper position.

FIGS. 3A and 3B illustrate a lower position (bolt released) and an upper position (bolt locked) of bolt catch system 100. As illustratively shown in FIG. 3A, when bolt catch system 100 is in a lower position, bolt catch 120 can be below bolt carrier 15, which allows the bolt carrier to freely move over the bolt catch. As illustratively shown, spring retention structure 131 can maintain the lateral position of a spring 5, which can compress against a portion of firearm receiver 10 and actuator 130 (i.e., an abutment surface), so as to bias system 100 in the lower position. And as illustratively shown in FIG. 3B, when bolt catch system 100 is in an upper position, bolt catch 120 can be positioned within the path of bolt carrier 15, which can lock the bolt carrier in place, which any desired purpose, such as for reloading or safety purposes, for example.

It will be apparent to one of ordinary skill in the art that the manner of making and using the claimed invention has been adequately disclosed in the above-written and attached description of the exemplary embodiments and aspects of the present invention.

It should be understood, however, that the invention is not necessarily limited to the specific embodiments, aspects, arrangement, and components shown and described above, but may be susceptible to numerous variations within the scope of the invention. For example, the present invention contemplates various shapes of the embodiments of the disclosed bolt catch system and corresponding adaptations of receivers to accommodate the same with all being design choices apparent to one of ordinary skill in the art.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents apparent to one of ordinary skill in the art.

The invention claimed is:

1. An ambidextrous bolt catch system configured for use in a firearm receiver having a rearward end, a forward end, a right side, and a left side, said system comprising:

a. a neck defining a planar element having upper, middle, and lower portions;

b. a bolt catch at the upper portion; and c. an ambidextrous actuator at the lower portion, said actuator having a spring retention structure;

d. wherein relative to a vector extending from the rearward end to the forward end, the middle portion extends along a plane perpendicular to the vector, and the planar element further has a concave section inset in the middle portion of said neck parallel to a longitudinal axis of the ambidextrous actuator.

2. The system of claim 1, wherein said actuator is integral with the lower portion.

3. The system of claim 1, wherein the upper, middle, and lower portions are integral.

4. The system of claim 1, wherein said neck has a uniform thickness.

5. The system of claim 1, wherein said bolt catch is configured to attach to the upper portion.

6. The system of claim 1, wherein the spring retention structure includes an abutment surface.

7. The system of claim 6, wherein the spring retention structure includes a protrusion.

8. The system of claim 1, wherein the spring retention structure includes a protrusion.

9. The system of claim 1, wherein the planar element includes a flat portion.

10. The system of claim 9, wherein said actuator is integral with the lower portion.

11. The system of claim 9, wherein the upper, middle, and lower portions are integral.

12. The system of claim 9, wherein said neck has a uniform thickness.

13. The system of claim 9, wherein said bolt catch is configured to attach to the upper portion.

14. The system of claim 9, wherein the spring retention structure includes an abutment surface.

15. The system of claim 14, wherein the spring retention structure includes a protrusion.

16. The system of claim 9, wherein the spring retention structure includes a protrusion.

* * * * *